United States Patent [19]

Haskel

[11] Patent Number: 5,037,110

[45] Date of Patent: Aug. 6, 1991

[54] GEOMETRIC CARD GAME

[76] Inventor: Michael Haskel, 136 W. Henrietta Ave., Oceanside, N.Y. 11572

[21] Appl. No.: 541,511

[22] Filed: Jun. 21, 1990

[51] Int. Cl.[5] ..... A63F 1/02

[52] U.S. Cl. ..... 273/293; 273/157 A

[58] Field of Search ..... 273/293, 157 R, 157 A

[56] References Cited

U.S. PATENT DOCUMENTS

| | | | |
|---|---|---|---|
| 2,911,220 | 11/1959 | Irwin | 273/293 |
| 3,016,243 | 1/1962 | Irwin | 273/157 A |
| 3,245,687 | 4/1966 | Irwin | 273/293 |
| 3,645,534 | 2/1972 | Weisbecker | 273/157 A |
| 4,298,200 | 11/1981 | Kanbar | 273/157 R |
| 4,362,301 | 12/1982 | Duveyoung | 273/157 A |
| 4,671,515 | 6/1987 | Burgess | 273/293 |

*Primary Examiner*—William H. Grieb
*Attorney, Agent, or Firm*—Notaro & Michalos

[57] ABSTRACT

A deck of playing cards and a card game to be played therewith comprises a plurality of transparent cards each having the same outer shape and size. Each card carries a colored area which may correspond to a primary shape, a secondary shape, a tertiary shape or a large master shape. Primary, secondary and tertiary shapes are selected so that they can be combined in various ways to make the master shape. The colors which may also be transparent are selected so that overlapping master shapes of secondary colors can be combined to form primary colors. The game using the cards is similar to the card game known as casino where cards are retrieved by matching shapes rather than card values and where building and doubling can be practiced.

18 Claims, 2 Drawing Sheets

GEOMETRIC CARD GAME

FIELD AND BACKGROUND OF THE INVENTION

The present invention relates in general to cards games, and in particular to a new and useful game which is based in part on the known game of casino, but which utilizes geometric and colored areas provided on transparent cards to produce a game having high interest value which can be played by young and old players alike.

The card game known as casino is played using conventional decks of 52 cards divided into four suits, with values from 2 to 10 plus Jack, Queen, King and Ace cards.

Casino is played by dealing out cards to multiple players and presenting a set of cards to all players on a playing surface or table. Players retrieve cards from the table by matching values between the cards dealt to the player and the cards on the table. Players can use higher value cards to retrieve combined cards from the table and may use other techniques such as building (where 1 card is laid on top of another for producing a combined value which the player can pick up during a subsequent turn using a card of equal value).

The use of cards carrying geometric shapes is known for example from U.S. Pat. No. 4,362,301 which discloses a game utilizing colored areas having intricate shapes and provided on transparent cards which can be combined in various ways to make even more intricate shapes. U.S. Pat. No. 4,298,200 discloses a card game which simulates an ancient Chinese puzzle known as Tangram where shapes are combined to form interesting figures. The use of transparent cards in a card game is also disclosed by U.S. Pat. Nos. 3,245,687 and 4,468,037.

SUMMARY OF THE INVENTION

An object of the present invention is to provide a casino like card game which, rather than using a conventional deck of cards, utilizes a unique deck of transparent cards which each have colored areas provided in shapes that can be used individually or combined with other like or different shapes to retrieve cards displayed on a playing surface. The uniqueness of the present invention lies both in the technique of using the geometric shapes to play the card game, and in the shapes themselves. One advantageous example of the invention utilizes square transparent cards that are about three inches on a side. Each card in the deck has a colored area which is also advantageously transparent. The shapes can be combined by superimposing and fully aligning the cards (to retain the overall square shape). An object of the invention is to match shapes and to form new shapes by superimposing the cards with the colored areas adjoining each other but no part of the colored areas overlapping each other.

In general the deck of cards of the present invention is divided into a first set of cards having a set of primary shapes such as rectangles or triangles covering half of the area of the card, a second set of cards having a plurality of secondary shapes, such as smaller triangles or squares which can be combined to form the primary shapes, and a third set of cards having colored areas in tertiary shapes which are smaller than the secondary shapes but can, in like fashion, be combined with other tertiary or secondary shapes to form the primary shapes.

The invention also includes master cards having a colored area in a master shape which either completely covers the card or covers a major portion of the card. Multiple, primary, secondary and/or tertiary shapes are used on overlapping cards to form the master shapes.

The use of different colors which, when superimposed, form additional colors can be used in a unique scoring system according to the present invention. One version of this scoring system involves the making of as many master shapes as possible with each master shape having a single color. Two master shapes of different colors can then superimposed to form a master shape having a composite color to increase the player's score. Other shapes are also possible.

One version of the invention utilizes polygonal shapes while another version of the invention uses circular, arched and sector shapes. Other shapes are also possible.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENTS

Figure 1:
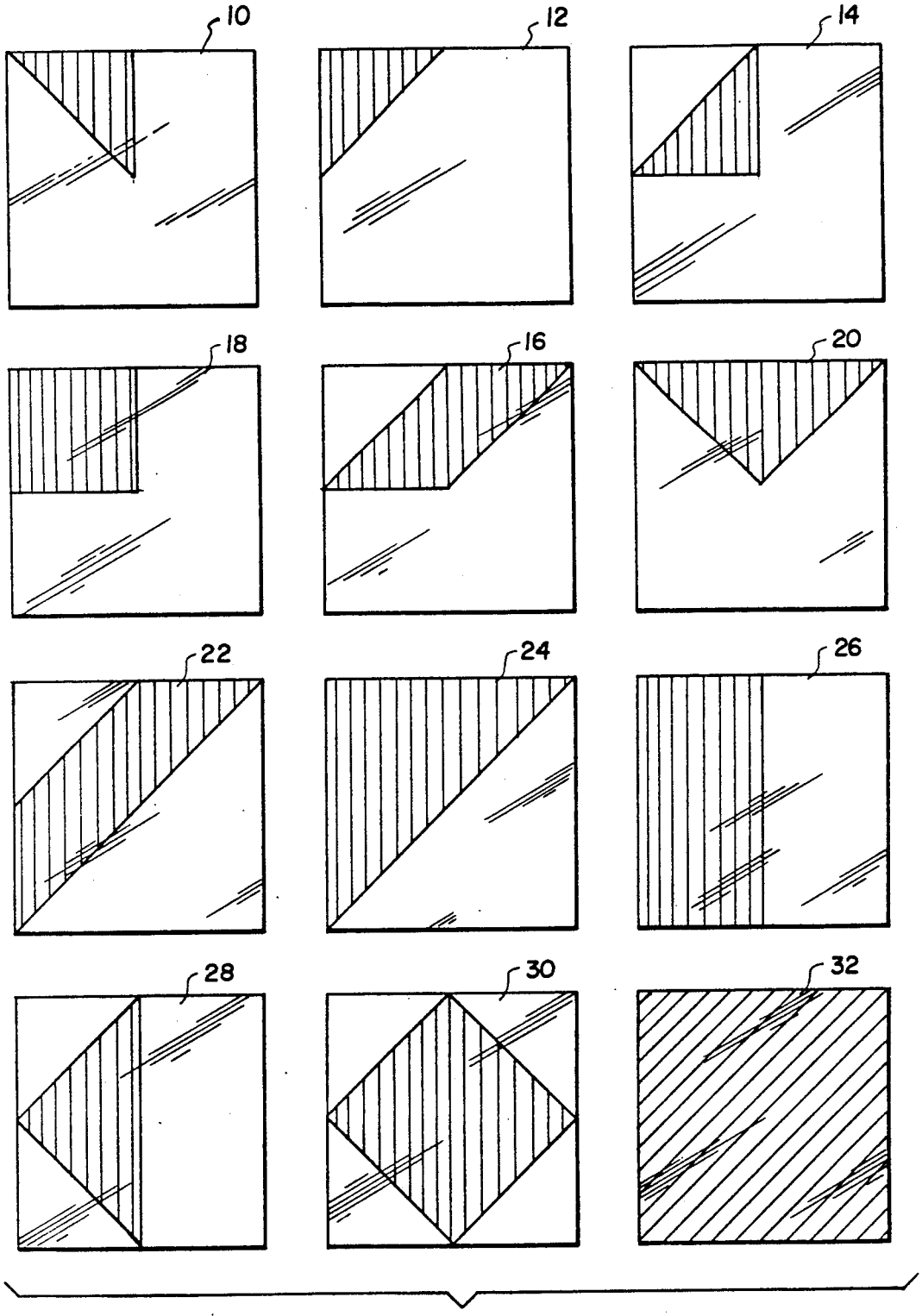
FIG. 1 is a top plan view of each type of card which is present in a first embodiment of the invention.
Figure 2:
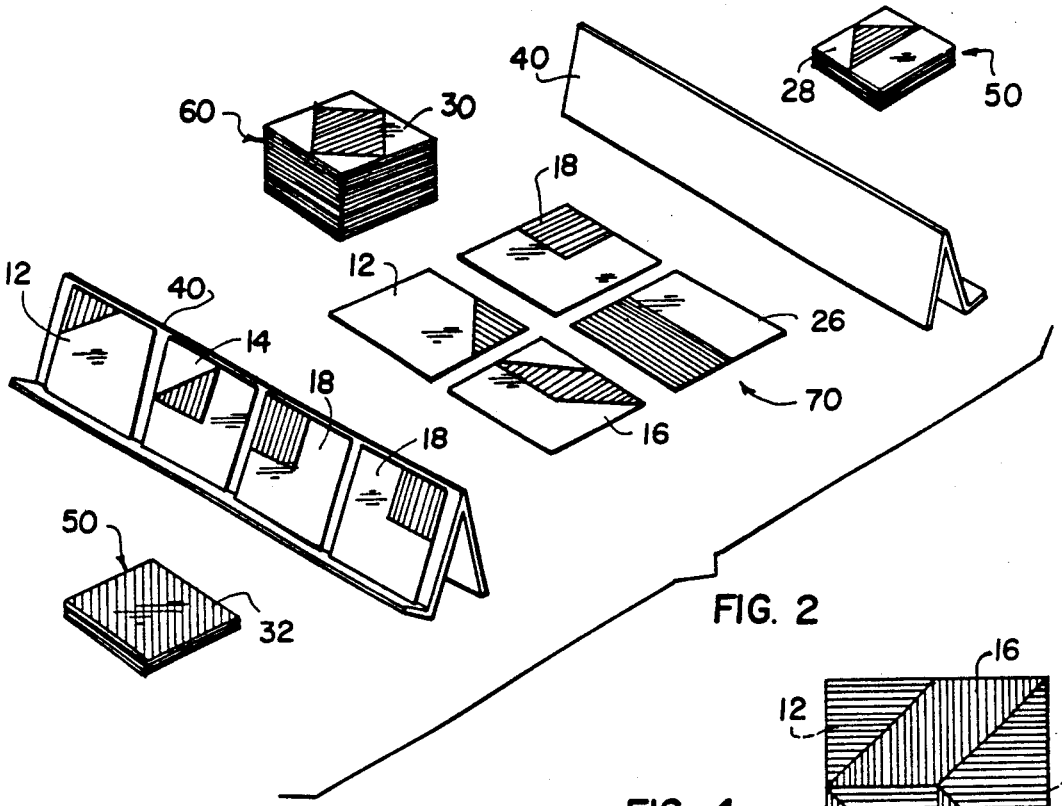
FIG. 2 shows a layout of a card game which can be played using the cards of the invention.

Referring to the drawings in particular, the invention therein comprises a card game and a deck of playing cards shown in FIG. 2. In the embodiment of FIG. 1, each of the cards is square and made of transparent plastic. Each card carries a colored area which, except for a master shape, may be red, yellow or blue.

For convenience and to add interest to the playing of the game, the inventor has selected certain descriptive names for each of the shapes represented by the colored areas.

The deck of cards according to the embodiment of FIG. 1 includes 124 cards.

The deck includes 24 sharkstooth cards 10, with 8 cards in each of red, yellow and blue. 18 corner cards 12 are included, 6 in each of the colors. 12 edgewedge cards 14 are also provided, with 4 in each of red, yellow and blue. The colored areas of cards 10, 12 and 14 are each in the form of a right triangle covering one eighth of the area of an outer shape of the square card. 8 cards 10 can be used to form the master shape 32, corresponding to the square outer shape of the card.

The deck also includes 12 lot cards 18 (4 in each color) which are corner squares covering 1 quarter of the master shape. 12 slide cards 16 are also provided (4 in each color). Each slide card is a parallelogram which can be formed from 1 sharkstooth 10 and 1 edgewedge 14. In this regard, it is noted that the cards may be rotated or flipped to bring the colored area into the correct orientation so that superimposed and aligned cards have colored areas which adjoin each other but overlap no portion of each other. The slide card 16 has a colored area covering 1 quarter of the master shape 32.

The deck also includes 12 flap cards 20 (4 in each color) which also cover 1 quarter of the area of the square and which can be formed by 2 sharkstooth cards 10.

The deck also includes 6 trap cards 22 (2 in each color), 6 slope cards 24 (2 in each color), 6 bar cards 26 (2 in each color) and 6 arrowhead cards 28 (2 in each color). 3 kite cards 30 are also provided, 1 in red, 1 in yellow and 1 in blue.

The deck is completed by 7 squares or master cards 32 which are completely colored, 2 in purple, 2 in green, 2 in orange and 1 in brown. The colors purple, green and orange are selected since they can each be made by 2 of the primary colors red, yellow or blue. Red and blue colored areas are superimposed to form purple for example while red and yellow superimposed areas form orange and yellow and blue superimposed areas form green. All three colors can be superimposed to form a dark color similar to the color of the brown card.

Figure 4:
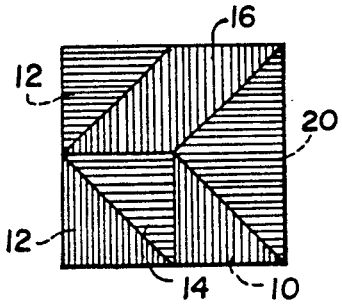
FIG. 4 is a top plan view of a set of cards from FIG. 1 which are superimposed to form a master shape.

The rules of the game require that the cards be superimposed and completely aligned with each other as shown in FIG. 4. FIG. 4 is an extreme example where the master shape 32 is formed by a stack of 6 transparent cards including 2 corner cards 12, 12, (1 of which being rotated through 90° or flipped upside down with respect to the other), 1 edgewedge card 14, 1 slide card 16, 1 sharkstooth card 10, and 1 flap card 20.

It is clear from FIG. 1 that the various primary shapes of cards 22, 24, 26, and 30 may be made of 2 or more tertiary shapes 10, 12 and 14, or by combining a secondary shape such as that on card 18, 16 or 20 with 1 or more tertiary shapes. For example, the bar card 26 can be made by 2 lot cards 18, by 1 lot card 18 and 2 sharkstooth cards 10, by 4 sharkstooth cards, or by a combination of corner cards 12 and edgewedge cards 14.

The shapes of the embodiment of FIG. 1 have been carefully selected because they can be combined in multiple ways to produce interesting interrelationships, particularly since the cards can be rotated and flipped upside down in use.

As shown in FIG. 2, 1 piece of hardware which is useful in playing the present invention is an opaque barrier or rack 40 which is provided to each player. 2 or more players can play a competitive game according to the present invention.

To play a game, the pile of cards 60, referred to as a draw pile, is shuffled with four cards being dealt to each player. Four of the cards are then exposed at 70. During the course of the game, cards are retrieved by the players according to the rules of the game, and placed in a retained pile 50 for each player.

The players take turns with cards being retrieved by matching shapes. Matching is done by superimposing colored shapes. A match can be achieved by superimposing one card from the player's rack onto one card in display area 70. Matching can also be done using two or more superimposed cards from the rack to make a shape as explained above, to match the shape on one of the displayed cards. Match is also possible using one or more player card to pickup one or more displayed card. The player whose cards are visible in FIG. 2 for example, may retrieve card 18 from area 70 by using 1 of his or her cards 18 on rack 40. Retrieval of the cards can also be achieved by combining 2 or more cards held by the player to form the shape of 1 card in area 70. For example the 2 cards 18, 18 may be superimposed to form a bar for retrieving the bar card 26.

Alternatively, the player can use a turn by combining corner card 12 with wedge card 14 to form a lot for retrieving card 18.

Cards in area 70 can also be combined to form shapes on cards held by the player although this cannot be done with the shapes in area 70 of FIG. 2.

If the player cannot make any match either by combining cards in his rack or by combining displayed cards in area 70, 1 of the player's cards must be placed in area 70. The move is completed by the player drawing as many cards from draw pile 60 as used during the turn. To maintain secrecy between the 2 players, the draw pile 60 and the retained piles 50 may be hidden in boxes or other receptacles with cards being drawn from and deposited in the piles as the game progresses.

During the course of the game, if at the end of a turn there are fewer than 4 cards on display area 70, new cards are drawn from pile 60 to increase the number of displayed cards to 4.

The game ends when no cards are left in draw pile 60 and no cards can be retrieved by either player. The last player to retrieve a card also receives all remaining displayed cards and all of the cards of his or her opponent(s).

In addition to retrieving cards by matching shapes, 2 additional techniques known as building and doubling are utilized. At a player's turn, if a player has a shape which when combined with a shape on one of the display can form a further shape which is represented in FIG. 1, then the player can announce that he or she is building. In the example shown, for example, the player's card 14 can be placed over displayed card 12 to form a lot shape 18. The player does this so that in a subsequent step one of the player's cards 18 can be used to retrieve both the composite card 12, 14 and the additional displayed lot card 18. The player who is "building" does risk having the built card retrieved by an opponent during an intervening turn however. All retrieved cards and all cards used by the play to retrieve the cards are placed in the player's retained pile 50.

Doubling is another technique which a player can use. Doubling is achieved by superimposing a card from the player's rack onto a displayed card in such a way that a colored shape on the player's card is superimposed onto a corresponding shape of the displayed card. Card 18 for example from the player's rack can be placed on card 18 in display area 70 with the player announcing that he or she is doubling. This is one of the three times colored areas of superimposed cards are also superimposed (the others being matching and the making of color combinations to be explained later). On a subsequent turn, if the doubled card has not been retrieved, the player can retrieve it with the remaining card 18 from rack 40. Tripling is also possible and done in the same way. A player can also combine shapes for doubling and tripling.

At the end of a game, scoring is conducted as follows:

1. Each player first counts up all of his or her cards and the player with the greatest number of cards receives 3 points.

2. Players then attempt to form the master shape or square 32 by superimposing multiple cards. Again the cards must be perfectly aligned with the colored areas adjoining each other but no part of the colored areas overlapping each other. Each master shape which is formed is worth one point.

3. If the master shape is formed of primary, secondary and/or tertiary shapes which are all of the same color, the player receives 2 points for that pure square. This scoring technique has been selected to increase the strategy with which a player retrieves cards. The player knows that more points are awarded for squares of single colors and this must be factored in during the game.

4. The green, violet and orange squares are worth 1 point each.

5. If a player is able to form pure squares of red, yellow or blue, and then can superimpose two pure squares with different primary colors to form either a green, purple or orange square, the composite is worth 9 points. That is, 2 points for each of the two color squares plus 5 bonus points for having produced a composite color square. The player receives 10 additional points if the player has or is able to make one each of green, purple and orange. An additional 5 points is awarded if the player also has the brown square. If present without all the other composite or pure color squares, the brown card is worth 3 extra points.

In addition to playing the game in a competitive manner, the invention can be used on a solitaire basis.

Figure 3:
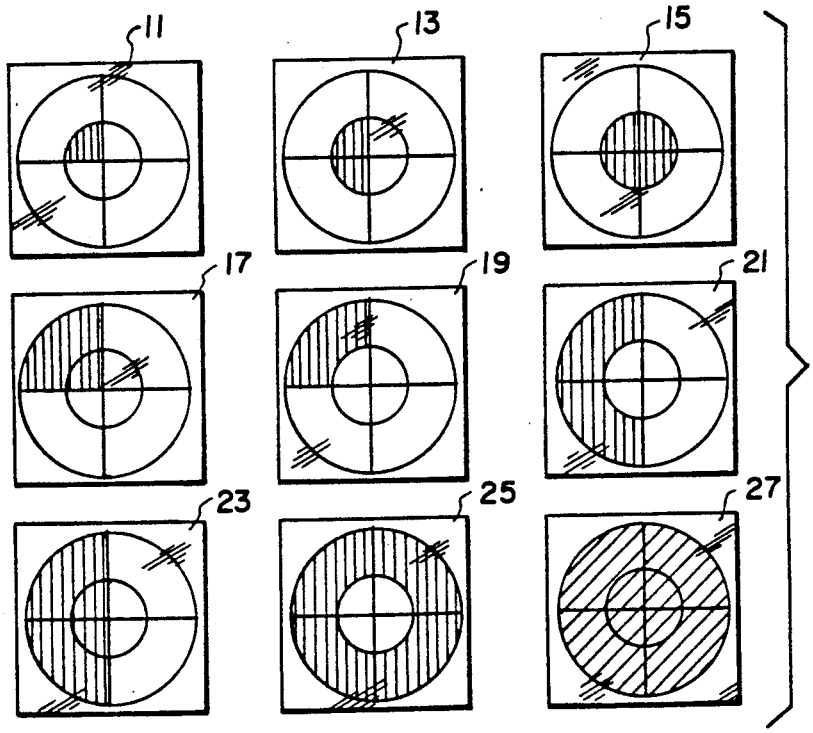
FIG. 3 is a view similar to FIG. 2 showing another embodiment of the invention.

FIG. 3 shows an alternate embodiment of the invention based on circular rather than square colored areas.

Again the inventor has selected names for each card for brevity and to add interest to the game. The deck of cards in FIG. 3 includes 67 cards.

This includes 12 bit cards 11, 4 in red, 4 in yellow and 4 in blue, the colored area in a bit card being one quarter of an inner circle.

6 chip cards 13 are also provided, 2 in each color. The colored area covers 1 half of the minor circle. The entire minor circle is filled with color in pea cards 15. 3 pea cards are present, 1 in each color. 12 slice cards 17 are provided, 4 in each color. One quarter of the master circle is covered by a color in each slice card. 12 chunk cards 19 (4 in each color and in the form of a quarter outer arch) are also provided. 6 cashew cards 21 and 6 half cards 23 are also provided (2 in each color). 3 donut cards 25 (1 in each color) and 7 pie cards 27 are also provided. The pie cards form the master shapes of the embodiment of FIG. 3 with 2 being in green, 2 in purple, 2 in orange and 1 in brown.

The play is the same as for the embodiment of FIG. 1 with shapes being combined by superimposing cards.

While a specific embodiment of the invention have been shown and described in detail to illustrate the application of the principles of the invention, it will be understood that the invention may be embodied otherwise without departing from such principles.

What is claimed is:

1. A deck of playing cards comprising:

a plurality of transparent cards each having the same outer shape and size, each card having a colored area;

the colored areas of a first set of said cards each having one of a plurality of primary shapes covering a major subdivision of the outer shape of each card in said first set;

the colored areas of a second set of said cards each having one of a plurality of secondary shapes covering a minor subdivision of the outer shape of each card in said second set and;

the colored areas of a third set of said cards each having one of a plurality of tertiary shapes covering a minor subdivision of at least some of said secondary shape and a minor subdivision of at least some of said primary shapes;

said primary, secondary and tertiary shapes being selected so that each of said secondary shapes can be made by superimposing and aligning at least 2 cards from said third set with their colored areas adjoining and no part of their colored areas overlapping, and each of said primary shapes can be made by superimposing and aligning at least 2 cards selected from a combined set including said second and third sets with their colored areas adjoining and no part of their colored areas overlapping.

2. A deck according to claim 1 including at least one additional card having the same outer shape and size as each of said plurality of transparent cards, said additional card having a colored area with a master shape covering at least a master portion of the outer shape of said additional card, at least 2 cards selected from a composite set including the cards in said first, second and third sets, forming said master shape when superimposed and aligned with their colored areas adjoining and no portion of their colored areas overlapping.

3. A deck according to claim 2 wherein each of said primary, secondary and tertiary shapes are provided on a plurality of cards having colored areas of different colors.

4. A deck according to claim 3 wherein said colored areas are transparent, said master shape having a color which can be formed by combining at least 2 of the different colors of said colored areas for said primary, secondary and tertiary shapes.

5. A deck according to claim 1 wherein said outer shape comprises a master square, and one of said primary shapes comprising a rectangle covering one half the area of said master square, one of said secondary shapes comprising a minor square covering one quarter of the area of said master square, 2 of said minor squares filling the area of said rectangle.

6. A deck according to claim 5 wherein another one of said primary shapes comprises a master triangle covering one half the area of said master square, another of said secondary shapes comprising a minor triangle covering one quarter of the area of said master square, 2 of said minor triangles filling the area of said master triangle.

7. A deck according to claim 6 wherein one of said tertiary shapes comprises a subminor triangle covering one eighth of the area of said master square, 2 of said subminor triangles filling the area of said minor triangle.

8. A deck according to claim 2 wherein said master shape is a circle, one of said primary shapes comprising a half circle and having the same diameter as said circle, one of said secondary shapes comprising a quarter circle having the same diameter as said circle.

9. A deck according to claim 8 wherein one of said tertiary shapes comprises a minor circle concentric with said first mentioned circle and having a smaller radius than said first mentioned circle.

10. A deck according to claim 9 wherein another of said tertiary shapes comprises a fraction of said minor circle.

11. A method of playing a card game utilizing a deck of playing cards having a plurality of transparent cards each having the same outer shape and size, each card having a colored area, the colored areas of a first set of said cards each having one of a plurality of primary shapes covering a major subdivision of the outer shape of each card in said first set, the colored areas of a second set of said cards each having one of a plurality of secondary shapes covering a minor subdivision of the outer shape of each card in said second set and, the colored areas of a third set of said cards each having one of a plurality of tertiary shapes covering a minor subdivision of at least some of said secondary shape and a minor subdivision of at least some of said primary shapes, said primary, secondary and tertiary shapes being selected so that each of said secondary shapes can be made by superimposing and aligning at least 2 cards from said third set with their colored areas adjoining and no part of their colored areas overlapping, and each of said primary shapes can be made by superimposing and aligning at least 2 cards selected from a combined set including said second and third sets with their colored areas adjoining and no part of their colored areas overlapping, the method comprising:

shuffling the deck of cards;

dealing a first number of cards to at least one player from the deck;

displaying a second number of the cards from the deck;

retrieving at least one of the second number of cards using at least one of the first number of cards having a colored area of a corresponding shape;

assembling the cards used from the first number of cards and the cards retrieved from the second number of cards in a retained pile;

replenishing the first number of cards from the deck;

replenishing the second number of cards from the deck; and repeating the step of retrieving cards.

12. A method according to claim 11, wherein the deck includes at least one master shape which can be made by superimposing the shapes on at least 2 cards selected from a combined set including said first, second and third set of cards with colored areas adjoining but not overlapping, the method including scoring the player at least partially on the basis of the number of master shapes which can be made by superimposing cards in the retained pile.

13. A method according to claim 12 including retrieving cards from the second number of cards by matching the shape on at least one of the second number of cards using superimposed cards from the first number of cards with adjoining but not overlapping colored areas.

14. A method according to claim 12 including retrieving a plurality of cards from the second number of cards which are superimposed with colored areas adjoining but not overlapping to form a composite shape, using one of the cards of said first number of cards carrying a colored area having the composite shape.

15. A method according to claim 12 wherein the deck includes plural cards carrying primary, secondary and tertiary shapes in multiple colors, the color of the at least one master shape being a combination of 2 colors of the primary, secondary and tertiary shapes, the method including scoring the player at least partly on the basis of making a master shape having the color of the master shape by combining combined sets of superimposed cards that each make the master shape.

16. A method according to claim 15 including a plurality of cards carrying the master shapes in different colors.

17. A method according to claim 16 wherein the cards are each square, the shapes all being polygons.

18. A method according to claim 17 wherein tertiary shapes are triangles, the secondary shapes include triangles, squares and rectangles and the primary shapes include rectangles and triangles.

* * * * *